US008215739B2

(12) United States Patent
Goto et al.

(10) Patent No.: US 8,215,739 B2
(45) Date of Patent: Jul. 10, 2012

(54) INK JET PRINTING METHOD AND MIST-REDUCTION-CONDITION SETTING APPARATUS

(75) Inventors: Fumitaka Goto, Tokyo (JP); Akitoshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1103 days.

(21) Appl. No.: 11/738,105

(22) Filed: Apr. 20, 2007

(65) Prior Publication Data

US 2007/0252869 A1 Nov. 1, 2007

(30) Foreign Application Priority Data

Apr. 28, 2006 (JP) ..... 2006-126864

(51) Int. Cl.
*B41J 29/38* (2006.01)
*B41J 2/165* (2006.01)

(52) U.S. Cl. ..... 347/14; 347/34

(58) Field of Classification Search ..... 347/14, 347/34

See application file for complete search history.

(56) References Cited

U.S. PATENT DOCUMENTS 6,137,507 A 10/2000 Inui et al.
6,692,097 B2 2/2004 Arima et al.
6,733,102 B2 5/2004 Hosono
6,866,358 B2 * 3/2005 Masuyama et al. ..... 347/14
6,964,466 B1 11/2005 Kodama et al.
7,296,868 B2 * 11/2007 Shibata et al. ..... 347/15

FOREIGN PATENT DOCUMENTS

| | | |
|---|---|---|
| JP | 10-44394 | 2/1998 |
| JP | 2000-127355 | 5/2000 |
| JP | 2000-351205 | 12/2000 |
| JP | 2002-086701 | 3/2002 |
| JP | 2002-192714 | 7/2002 |
| JP | 2004-268426 | 9/2004 |
| JP | 2005-96382 | 4/2005 |
| JP | 2005-153340 | 6/2005 |

* cited by examiner

*Primary Examiner* — Geoffrey Mruk

(74) *Attorney, Agent, or Firm* — Fitzpatrick, Cella, Harper & Scinto

(57) ABSTRACT

Before a printing operation, printing conditions related to occurrence of mist are acquired. According to the printing conditions, mist reduction device and a mist-reduction correction amount for controlling a degree of reducing the mist by the mist reduction device are set. Thereafter, printing is performed on a print medium by use of the set mist-reduction correction amount and mist reduction device. Accordingly, an appropriate mist reduction method is adopted according to the various printing conditions. Thus, optimum printing can be executed without impairing image quality or user-friendliness more than necessary.

6 Claims, 13 Drawing Sheets

| | | | |
|---|---|---|---|
| 96 | 176 | 64 | 128 |
| 144 | 16 | 240 | 32 |
| 80 | 192 | 112 | 224 |
| 160 | 0 | 208 | 48 |

FIG.10A

| | | | |
|---|---|---|---|
| 96 | 178 | 64 | 128 |
| 144 | 16 | 244 | 32 |
| 80 | 195 | 112 | 228 |
| 161 | 0 | 212 | 48 |

FIG.10B

INK JET PRINTING METHOD AND MIST-REDUCTION-CONDITION SETTING APPARATUS

BACKGROUND OF THE INVENTION

1. Field of the Invention

The present invention relates to an ink jet printing method and a mist-reduction-condition setting apparatus. More particularly, the present invention relates to a setting of conditions for maintaining high image quality while reducing mist caused by ink jet printing.

2. Description of the Related Art

Along with the proliferation of ink jet printing apparatuses, image quality and handling equivalent to those in silver-halide photography have been increasingly demanded. In a case where an image outputted by a conventional color ink jet printing apparatus is compared with the silver-halide photography, granularity in an image has long been seen as a problem in particular. The granularity is defined as an impression similar to a sense of roughness perceived when ink droplets printed on a print medium are visually recognized as dots. In order to reduce the granularity, provided recently is an apparatus which performs printing by using light color ink having lowered colorant concentration, in addition to basic four colors of cyan (C), magenta (M), yellow (Y) and black (K). Examples of the light color ink are light cyan (LC), light magenta (LM), light yellow (LY), light black (LK) and the like. Furthermore, also provided is an ink jet printing apparatus which is prepared in advance to handle so-called secondary color ink (particular color ink), such as red (R), green (G) and blue (B), in order to express a wide color gamut equivalent to that of the silver-halide photography.

Another reason why the granularity degrades the image quality is a low spatial frequency of dots arranged in a highlight region. To reduce the granularity, it is also effective to increase the spatial frequency, that is, to reduce a dot size, and to increase the number of dots.

For the above reason, recently, many ink jet printing apparatuses which uses the light color or particular color ink in conjunction with basic four color inks, and uses a print head which ejects small ink droplets of 2 pl or less, have been provided for achieving the quality equivalent to silver-halide photography.

In addition, the ink jet printing apparatus for achieving an outputted image equivalent to that of the silver-halide photography, also needs to be able to perform printing on the entire surface of the print medium (margin-less printing). In a case where the margin-less printing is performed by the ink jet printing apparatus, a significant problem is that a printed object and the inside of the apparatus are contaminated with ink ejected outside edges of the print medium at the time of printing. Japanese Patent Laid-Open No. 2000-351205 discloses an ink jet printing apparatus and an ink jet printing method contrived so as not to contaminate a print medium with ink ejected outside the print medium.

FIG. 1 is a view for explaining the ink jet printing method described in Japanese Patent Laid-Open No. 2000-351205. In FIG. 1, reference numeral 201 denotes a print head which is, here, in a state of carrying out printing in a front end portion of a print medium 207. The print medium 207 is fed and conveyed on a platen 206 which supports the print medium 207 from below, while being held with a pair of rollers which are a conveyance roller 202 and an auxiliary roller 203. Moreover, a front end of the print medium 207 is set in a position where printing can be performed by the print head 201. In the configuration disclosed in Japanese Patent Laid-Open No. 2000-351205, a hole H is provided to the platen 206, and an absorber for absorbing ink is further provided to the inside of the hole.

FIG. 2 is an enlarged view for specifically explaining a printing part shown in FIG. 1. As shown in FIG. 2, ink ejected outside the print medium 207 is absorbed by an absorber 209 disposed inside the hole H. As described above, by collecting, at a predetermined spot, the ink not applied onto the print medium, the print medium and the inside of the apparatus can be prevented from being contaminated, even though they might otherwise be contaminated due to scattering of the ink. With reference to FIG. 2, the explanation has been provided for the example of printing in the front end portion of the print medium. Meanwhile, the same explanation can be provided for printing in a rear end portion and in right and left end portions.

The position of the front end of the print medium is usually detected in the ink jet printing apparatus. Thus, margin-less printing can be performed without intentionally ejecting the ink to a region outside the print medium. However, a slight error inevitably occurs in terms of a degree of accuracy in conveying the print medium or in an ejection direction. For this reason, in order to achieve stable margin-less printing, it is desirable that the ink be ejected, to some extent, to the region outside the print medium. Note that an amount of ink ejected outside the print medium can be suppressed to be smaller than an amount of ink ejected onto the print medium. Japanese Patent Laid-Open No. 2002-086701 discloses a method for controlling an amount of ink applied near an edge of a print medium by processing image data, reducing energy for ejection or using a mask pattern to be described later, in margin-less printing.

However, the recent trends of using smaller ink droplets, margin-less printing, and an increase of colors of used ink have accelerated generation and scattering of mist inside the ink jet printing apparatus. The mist in the ink jet printing apparatus will be described below.

In the present specification, the mist is defined as minute ink droplets scattering inside the apparatus, unlike ink droplets ejected toward the print medium from the print head. Although the mist is generated in various circumstances, the mist is especially likely to be generated when the margin-less printing is performed, for example. This is because ink droplets ejected to the absorber positioned farther than the print medium is influenced by an airflow, air resistance and the like in a movement path of it, and then kinetic energy of ink droplet in a direction toward the absorber is likely to be lost.

It has been confirmed that such a mist causes various adverse effects on image quality and on the printing apparatus. The mist not reaching the print medium or the absorber scatters inside the apparatus, and contaminates various pieces of equipment by adhering thereto. For example, when a surface of the platen 206 shown in FIG. 1 or FIG. 2 is contaminated, the back side of the print medium 207 passing on the platen 206 is also contaminated. In this event, in a case where double-sided printing is executed for printing on front and back surfaces of the print medium, each printing surface itself is contaminated. Moreover, in a case where the apparatus includes an encoder for obtaining a current position of the print head 201, contamination of the encoder with the mist does not allow the encoder to accurately detect the position of the print head 201. As a result, printing positions of dots are shifted, and thereby the image quality is deteriorated.

In Japanese Patent Laid-Open No. 2002-086701, the mist in the margin-less printing is particularly seen as a problem. For the margin-less printing, the mist is reduced by controlling an amount of ink applied to the edge of the print medium.

However, the margin-less printing is not the only factor which causes the mist. Even when the margin-less printing is not performed, generation of the mist may be seen as a problem. For recent ink jet printing apparatuses, there has been developed a technology of printing with a wide variety of ink by applying small ink droplets at a high frequency and with high density, in order to allow faster output of higher quality images. In such a situation, adverse effects of the mist are greatly concerned even when the margin-less printing is not performed.

However, the method described in Japanese Patent Laid-Open No. 2002-086701 only aims at the margin-less printing, and cannot sufficiently respond to the recently-observed adverse effects of the mist. Moreover, with a method of changing printing conditions only by confirming whether or not to perform the margin-less printing, the image quality is sometimes rather deteriorated than improved by reducing the application amount of ink more than necessary.

SUMMARY OF THE INVENTION

The present invention has been made to solve the problems described above. An object of the present invention is to provide a mist-reduction-condition setting apparatus which allows optimum output of a high-quality image while effectively reducing occurrence of mist.

The first aspect of the present invention is a mist-reduction-condition setting apparatus for setting a mist reduction condition for reducing ink mist caused by ink ejection from a print head, comprising: means for acquiring printing conditions related to occurrence of the ink mist; and means for setting the mist reduction condition corresponding to the acquired printing conditions from a plurality of different mist reduction conditions.

The second aspect of the present invention is an ink jet printing method for printing an image on a print medium by use of a print head which ejects ink, comprising the steps of: acquiring printing conditions related to occurrence of ink mist; setting a mist reduction condition for reducing the ink mist, according to the acquired printing conditions; and performing printing on the print medium on the basis of the acquired mist reduction condition.

The third aspect of the present invention is a system including an ink jet printing apparatus which prints an image on a print medium by use of a print head which ejects ink, and an external device connected to the printing apparatus, comprising: means for acquiring printing conditions related to occurrence of ink mist; means for setting mist reduction means for performing processing for reducing the ink mist, and a mist reduction parameter for controlling a degree of reducing the mist by the mist reduction means, according to the printing conditions; and means for performing printing on the print medium by applying the set mist reduction means on the basis of the set mist reduction parameter.

The fourth aspect of the present invention is a program for setting a mist reduction condition for reducing ink mist caused by ink ejection from a print head, the program causing a computer to execute the steps of: acquiring printing conditions related to occurrence of the ink mist; and setting the mist reduction condition corresponding to the acquired printing conditions from a plurality of different mist reduction conditions.

Further features of the present invention will become apparent from the following description of exemplary embodiments (with reference to the attached drawings).

BRIEF DESCRIPTION OF THE DRAWINGS

FIGS. 10A and 10B show threshold tables adopted in dithering;

DESCRIPTION OF EMBODIMENTS

First Embodiment

With reference to the drawings, an ink jet printing apparatus applied in an embodiment of the present invention will be described below in detail.

Figure 1:
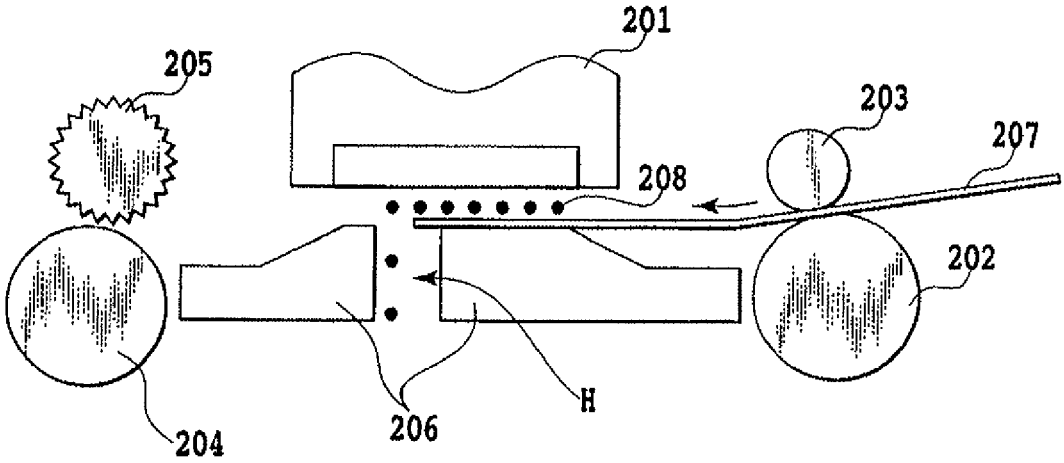
FIG.1 PRIOR ART
FIG. 1 is a view for explaining an ink jet printing method described in Japanese Patent Laid-Open No. 2000-351205.
Figure 2:
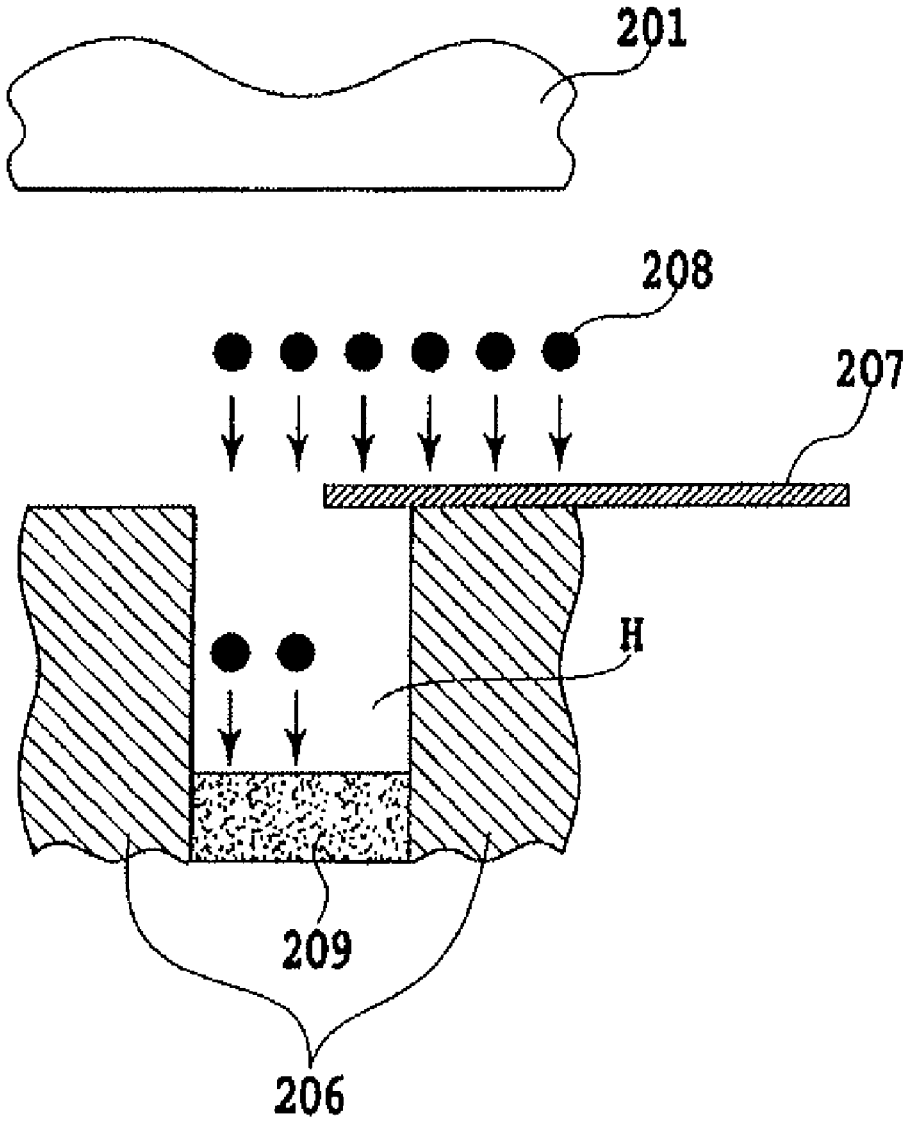
FIG.2 PRIOR ART
FIG. 2 is an enlarged view for explaining a printing part shown in FIG. 1.
Figure 3:
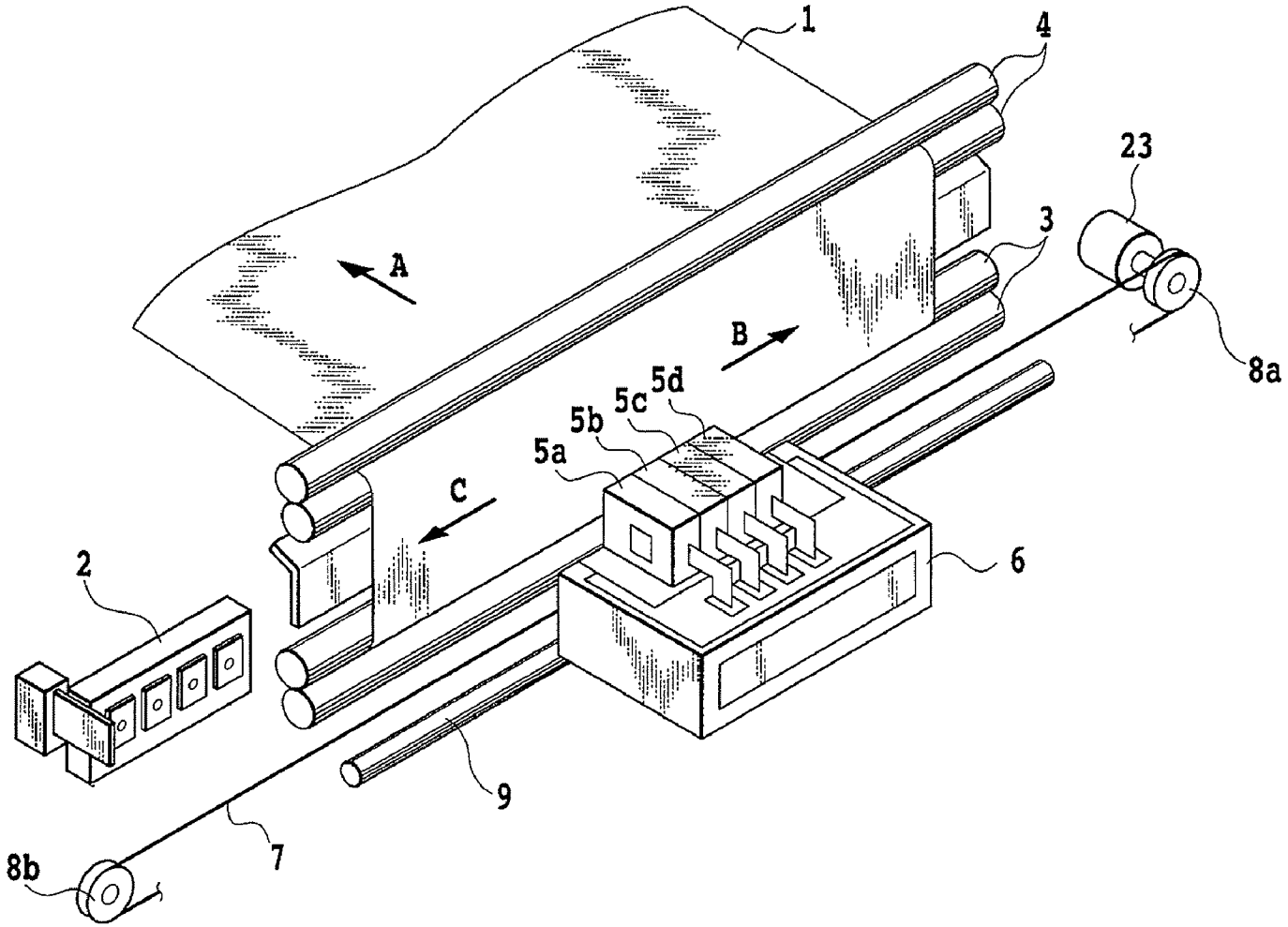
FIG. 3 is a schematic diagram of an ink jet printing apparatus applied in an embodiment of the present invention.

FIG. 3 is a schematic diagram of the ink jet printing apparatus applied in this embodiment. From a cassette (not shown) or the like, in which a plurality of print medium 1 made of paper or plastic sheets can be stacked, the print medium 1 are fed one by one to the printing apparatus by a paper feed roller (not shown). Pairs of conveyance rollers 3 and 4 are disposed with a predetermined distance interposed therebetween, and are respectively driven by drive motors thereof to convey the print medium 1 in a direction indicated by the arrow A in FIG. 3.

Ink jet print heads 5*a* to 5*d* for printing an image on the print medium 1 eject ink supplied from an unillustrated ink cartridge through a plurality of printing elements, according to an image signal. Each of the printing elements includes an ink path for holding the ink and energy generation means for ejecting the ink as droplets. Examples of the energy generation means include a heating element (a heater) which generates heat according to an applied voltage pulse, and a piezoelectric element. The heater rapidly generates heat according to the applied pulse, and generates bubbles in the ink to eject the ink as the droplets. The piezoelectric element is changed shape mechanically by an applied voltage, and applies pressure to the ink to thereby eject the ink as the droplets. The print heads 5 in this embodiment may employ any one of the energy generation means.

The print heads 5 and the ink cartridge are mounted on a carriage 6. The carriage 6 is connected to a carriage motor 23 by means of a belt 7 and pulleys 8*a* and 8*b*, and is guided and supported by a guide shaft 9. The above configuration allows the carriage 6 to perform reciprocating scanning in directions indicated by the arrows B and C by being driven by the carriage motor 23. Moreover, although not shown in FIG. 3, an encoder is provided to a scanning direction of the carriage 6. An encoder sensor provided to the carriage 6 can read a current position of the carriage 6 by scanning while reading the encoder. The ink corresponding to image data is ejected by the print heads 5 while keeping track of the current position of the carriage 6 during the scanning by the carriage 6. Thus, an image for 1 scan is formed on the print medium 1.

When one printing scan is complete, the pairs of conveyance rollers 3 and 4 are rotated by a conveyance roller drive motor to convey the print medium by an amount corresponding to a printing width of the print heads 5 in the direction of the arrow A which is a sub-scanning direction. By alternately repeating the printing scan and the conveying operation described above, the image is gradually formed on the print medium 1.

The print heads 5*a* to 5*b* are moved to a home position as appropriate, and are subjected to maintenance processing such as cleaning clogged nozzles by a recovery device 2.

Figure 4:
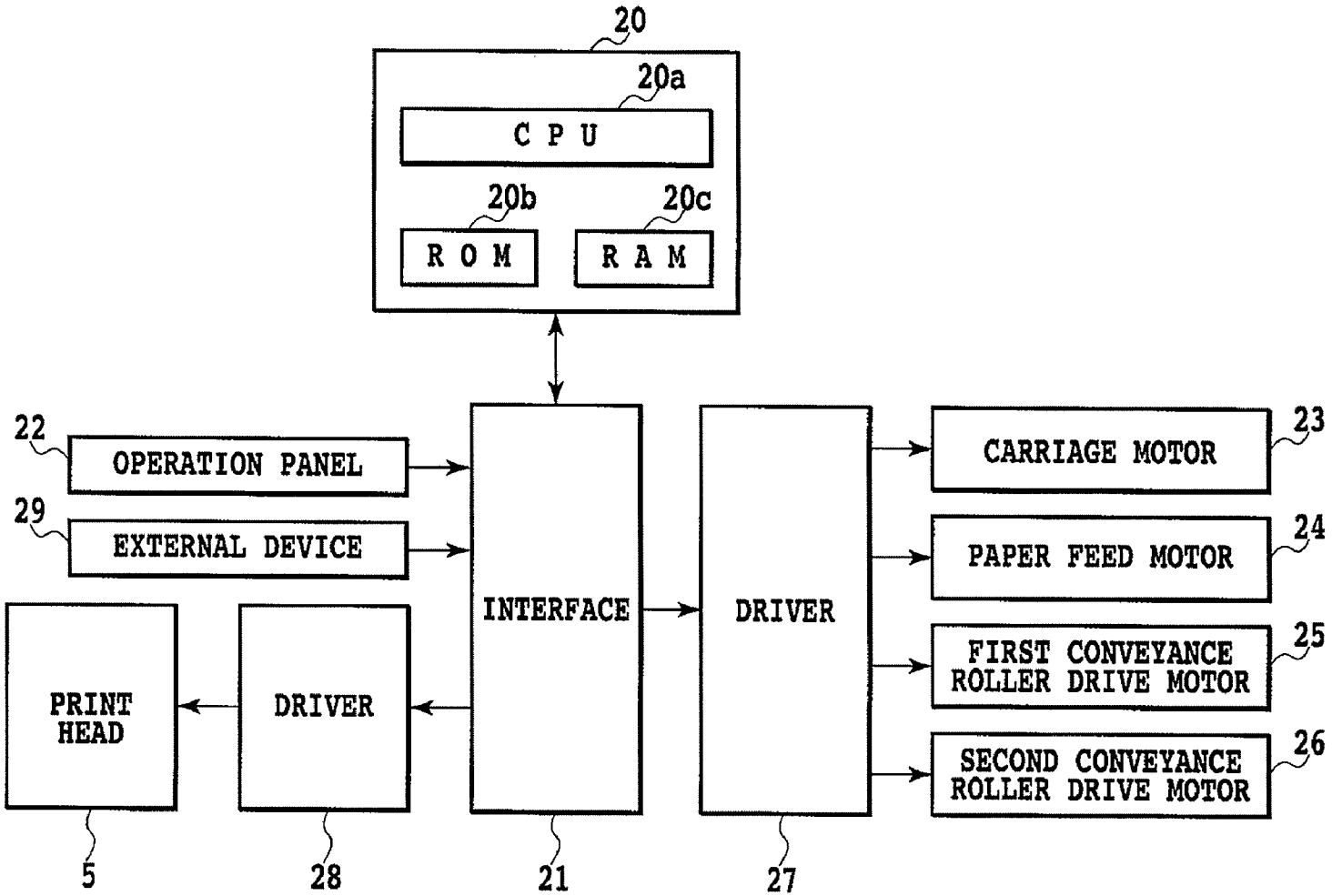
FIG. 4 is a block diagram for explaining a configuration of a control system in the ink jet printing apparatus applied in the embodiment of the present invention.

FIG. 4 is a block diagram showing a configuration of a control system in the ink jet printing apparatus according to this embodiment. In FIG. 4, a controller 20 is responsible for controlling the entire printing apparatus, and includes, for example, a CPU 20*a* such as a microprocessor, a ROM 20*b*, a RAM 20*c* and the like. The ROM 20*b* stores control programs to be executed by the CPU 20*a*, various data, and the like. The RAM 20*c* is used as a work area for the CPU 20*a*, and temporarily stores printing data, mask patterns to be described later, and the like.

The controller 20 is connected, via an interface 21, to an operation panel 22, an external device 29, a driver 27 for driving the various motors, and a driver 28 for driving the print heads 5. The controller 20 receives various information (for example, a character pitch, types of characters, and the like) obtained from the operation panel 22, image data from the external device 29, and the like. Concurrently, the controller 20 transmits status information on the apparatus and the like to those described above. Moreover, in order to drive the carriage motor 23 for driving the carriage 6, a paper feed motor 24 for driving the paper feed roller, and first and second conveyance roller drive motors 25 and 26 for driving the pairs of conveyance rollers 3 and 4, the controller 20 outputs on-off signals to the motor drivers 27 for the respective motors. Furthermore, the controller 20 reads printing data corresponding to one scan of the print heads 5*a* to 5*d* from the RAM 20*c*, and outputs the read printing data to the driver 28 for the print heads. Thus, the ink is ejected from the print heads 5 at a predetermined timing.

In an ink jet printing system of this embodiment, main image processing is performed, for example, by the external device 29 such as a personal computer (PC). A user can control the printing apparatus by accessing a printer driver installed into the external device 29. To be more specific, in addition to a printing start command, the type of print medium and a printing mode such as whether or not to perform margin-less printing can be set in the printer driver.

Figure 5:
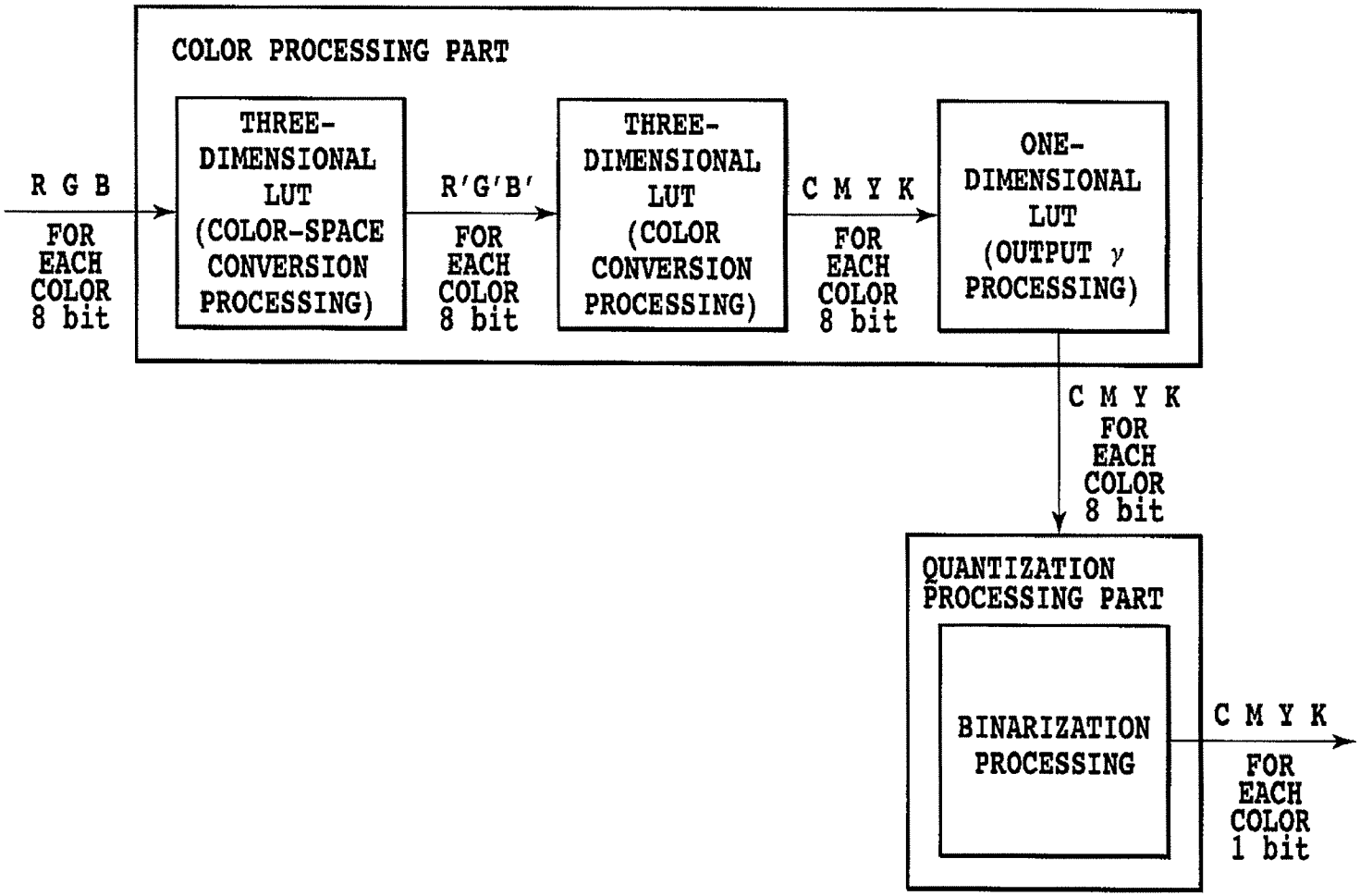
FIG. 5 is a block diagram for explaining steps of image processing executed in the embodiment of the present invention.

FIG. 5 is a block diagram for explaining steps of image processing executed in this embodiment. Image data created by applications and the like, or image data inputted from a digital camera and the like, are often different from color spaces which can be printed by the printing apparatus. In the image processing of this embodiment, the image data is first subjected to color space conversion processing so as to be corrected and converted into color spaces which can be printed with the printing apparatus of this embodiment. To be more specific, by referring to a previously-prepared three-dimensional LUT, 8-bit R, G and B signals are converted into 8-bit R', G' and B' signals.

The data to which the color space conversion processing has been performed is next subjected to color conversion processing. Specifically, luminance signals expressed with three primary colors of red, green and blue, are converted into density signals of cyan (C), magenta (M), yellow (Y) and black (K) corresponding to ink colors used in the printing apparatus. Also in the color conversion processing, by referring to a previously-prepared three-dimensional LUT, the 8-bit R', G' and B' signals are converted into 8-bit C, M, Y and K signals.

In the three-dimensional LUT used in the color space conversion processing or in the color conversion processing, actually non-continuous discrete data is stored. In a case of executing conversion processing of each data, output values are set by interpolation processing using approximate data values. A heretofore-known technology can be adopted for such interpolation processing.

The 8-bit C, M, Y and K data to which the color conversion processing has been performed are subsequently subjected to output γ correction. Generally, in the ink jet printing apparatus, the number of dots printed in a unit area of the print medium and optical density expressed therein are not in a linear relationship with each other. For this reason, in the output γ processing, a one-dimensional LUT is used to perform such correction that density values on the print medium for the inputted C, M, Y and K data approximately form a line.

Each piece of the C, M, Y and K data to which the output γ correction has been performed are 8-bit data, and have 256 gradation values. However, the ink jet printing apparatus used in this embodiment can print only binary data indicating whether or not dots are to be printed. Consequently, in the next quantization processing, the 8-bit C, M, Y and K data are converted into 1-bit (binary) C, M, Y and K data.

Although various techniques have been proposed as the quantization processing, an error diffusion method, dithering or the like is generally adopted. In the error diffusion method, printing or not printing each pixel is set by comparing a preset threshold with multi-level data (a gradation value) of each pixel. Concurrently, an error generated between the threshold and the gradation value is allocated to surrounding pixels. By sequentially executing quantization of the respective pixels while repeating above-described determination on whether or not printing is performed and error allocation, a gradation value given to a target pixel is represented in a region including adjacent pixels.

On the other hand, in the dithering, a threshold for quantization of a predetermined region is previously-prepared as a threshold pattern. In quantization, whether or not printing is performed is determined by comparing 8-bit data (the gradation value) of each pixel with the threshold in the threshold pattern corresponding to the pixel.

In this embodiment, the series of image processing described above is performed by the external device 29, and 1-bit C, M, Y and K data to which binarization processing has been performed are inputted to the printing apparatus. This 1-bit data is data in which whether or not dots are printed is set for each printing pixel. Thus, an image can be formed by ejecting the ink from the print heads according to just the data. However, in the ink jet printing apparatus of this embodiment, it is also possible to execute multi-pass printing by using previously-prepared mask patterns. The multi-pass printing will be briefly described below.

Figure 6A:
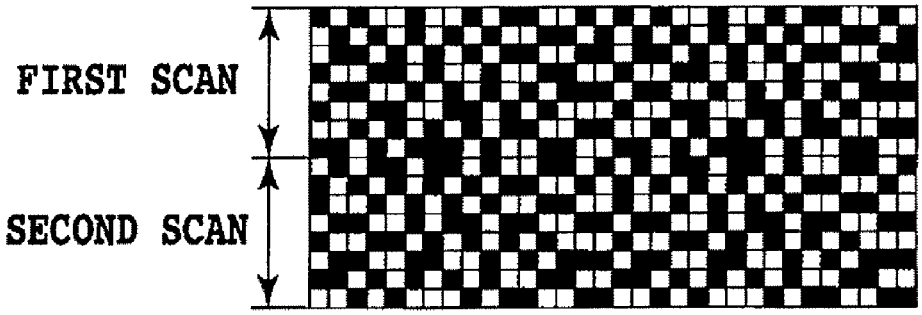
FIGS. 6A and 6B are schematic views for explaining a multi-pass printing method.
Figure 6B:
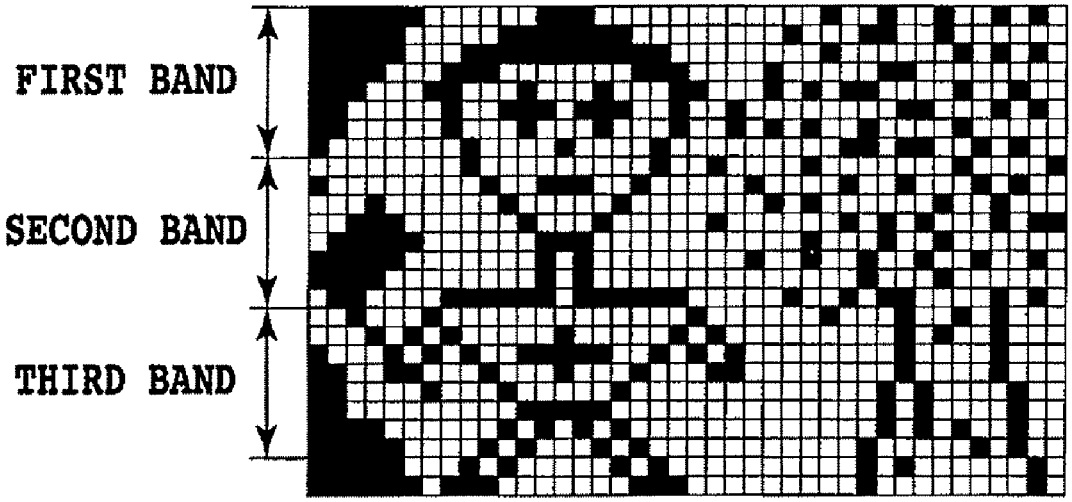

FIGS. 6A and 6B are schematic views for explaining a multi-pass printing method. FIG. 6A shows an example of a mask pattern applicable to 2-pass printing. In FIG. 6A, black areas indicate pixels in which printing is allowed in printing scans (print permission pixels), and white areas indicate pixels in which printing is not allowed (print non-permission pixels). The pixels arranged in the vertical direction correspond to each of the printing elements arranged on the print head. Here, for simplicity, description will be given of a case where a print head having 16 printing elements is used, for example, to perform printing for 32 pixels in a main scanning direction. In one event of main scanning for printing, each of the printing elements is allowed to print for about half the number of pixels to be printed. A region indicated in FIG. 6A as a first scan and a region indicated as a second scan are in a completing relationship with each other.

FIG. 6B shows an example of binary data to be actually printed. In FIG. 6B, black areas indicate pixels in which dots are printed, and white areas indicate pixels in which no dots are printed. In the multi-pass printing, prior to each printing scan, the mask pattern shown in FIG. 6A and the binary data shown in FIG. 6B are ANDed to obtain new binary data. This binary data corresponds to pixels in which dots are actually printed with the print head in one printing scan. When one printing scan is complete, the print medium is conveyed by an amount (here, by 8 pixels) corresponding to half the number of printing elements. Thereafter, when determining ejection data for the next printing scan, the mask pattern shown in FIG. 6A and the binary data shown in FIG. 6B are ANDed again in a state where the mask pattern is shifted by 8 pixels in a sub-scanning direction, from the binary data. Thus, new binary data is obtained.

By alternately repeating the printing scan based on the AND processing and the conveying operation as described above, the image is printed while overlapping the printings of the first and second scans with each other on the print medium. Regarding the plurality of printing pixels arranged in the main scanning direction, dots are formed therein by two kinds of printing elements.

In processes for manufacturing the ink jet print head, a slight variation is inevitably included among the plurality of arranged printing elements. Such a variation emerges as a printing state of dots on the print medium. For example, lines in the main scanning direction, which are printed with the printing elements varying in an ejection direction or with the printing elements having a small or large ejection amount, are recognized as adverse effects on the image, such as white stripes and black stripes. However, by adopting the multi-pass printing method as described above, a line extended in the main scanning direction is printed not by a single printing element, but by two printing elements. Specifically, dots printed with the printing elements varying in the ejection direction or with the printing elements having the small or large ejection amount are not continuously arranged in the main scanning direction. Thus, the adverse effects such as white stripes and black stripes are dispersed in the entire image, and are less noticeable.

In the above description, for simplicity, the mask pattern having 16 pixels in the sub-scanning direction×32 pixels in the main scanning direction is taken as an example. Meanwhile, the mask pattern actually has regions corresponding to the number of printing elements of the print head in the sub-scanning direction, and has more regions also in the main scanning direction. Even if the number of pixels in the main scanning direction within the mask pattern is less than the number of pixels within an image data width, the entire image region of the print medium can be completed by repeatedly using one mask pattern as it is or by repeatedly using the mask pattern while offsetting thereof.

Although the 2-pass printing method has been described with reference to FIGS. 6A and 6B, the number of passes for the multi-pass printing is not limited to two. For example, more passes can be set, such as 3 passes, 4 passes and 6 passes. In this case, a printing permission rate (a proportion of print permission pixels) of the mask pattern to be adopted, or how much of the print medium is conveyed may be controlled according to the number of passes. In general, the larger the number of passes is, the more the number of printing elements for forming a line extended in the main scanning direction increases. Thus, a smoother image can be expected.

Figure 7:
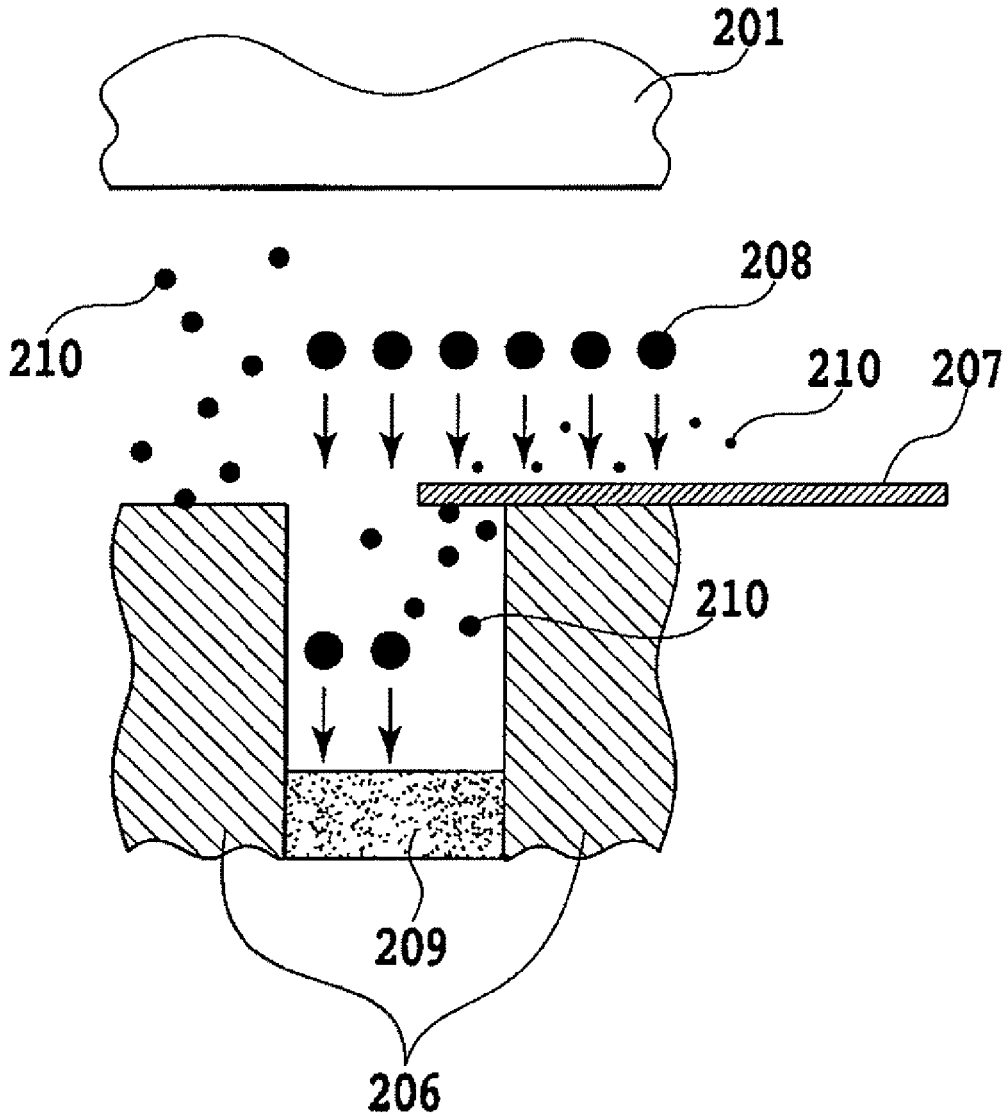
FIG. 7 is a schematic view for explaining a situation where mist occurs.

FIG. 7 is a schematic view for explaining a situation where mist 210 occurs in the printing apparatus of this embodiment. Here, FIG. 7 shows a state where ink is ejected near the front end of the print medium 207 at the time of the margin-less printing. Various timings at which the mist occurs will be described below in stages.

When the ink is ejected from the print head 201, main droplets 208 fly toward the print medium 207. The mist 210 occurs at the time when the main droplets are ejected. In a second case, the main droplets 208, during flying, are influenced by an airflow to cause the mist 210 separated from the main droplets 208. In a third case, the droplets lose kinetic energy thereof on the way to the absorber 209 after the droplets are ejected to the outside of the print medium 207, and thereby cause the mist 210. In a fourth case, the mist 210 is caused by a splash of the main droplets 208 at the time when the main droplets 208 land on the print medium 207. In a fifth case, the mist 210 is caused by an impact of new main droplets 208 on the surface of the print medium 207 in which the previously-applied ink remains unabsorbed.

As described above, the mist occurs at various timings. Meanwhile, in the recent ink jet printing apparatus, main factors for increasing the mist are a small size of each main droplet and the margin-less printing. According to a study done by the inventors of the present invention, it is confirmed that various conditions in printing change an amount of generated mist, as is similar to the fact that there are various factors for occurrence of the mist. The conditions which induces occurrence of the mist will be listed below by items.

(1) Carriage speed: the faster carriage speed influences the airflow more, and thereby the mist more likely occurs.

(2) Drive frequency: the higher drive frequency more likely causes the mist.

(3) Image density: the higher image density increases the ejection frequency and splash, and more likely causes the mist.

(4) A volume of ejection data: the larger volume of ejection data more likely causes the mist.

(5) A printing position: the mist more likely occurs in printing toward the edge of the print medium.

(6) An ejection amount: the mist more likely occurs when small ink droplets are ejected.

(7) A type of ink: the occurrence frequency of the mist varies with physical properties and components of ink.

(8) A type of print medium: a low absorption coefficient of the print medium increases the splash, and induces occurrence of the mist.

(9) A distance to the paper between surface of ejection port and print medium (or absorber): the longer distance to the paper more likely causes the mist.

(10) A printing environment: the occurrence frequency of the mist varies with temperature and humidity.

The inventors of the present invention have focused on the fact that the amount of generated mist can be predicted to some extent in advance by grasping the above-listed conditions at the time of printing, as in much detail as possible before the printing operation. Moreover, the inventors of the present invention have determined that optimum image output can be achieved, without reducing the ink application amount more than necessary or causing adverse effects on user-friendliness, by properly performing control of suppressing occurrence of the mist according to the predicted situations and the amount of mist to be generated.

Moreover, the amount of mist generated during the printing operation is measured, and the control is carried out to properly suppress occurrence of the mist according to the actually-measured amount of mist. For example, if the actually-measured amount of mist is more than the predicted amount, the current printing operation is switched to a printing operation in which occurrence of the mist is more suppressed, by use of a mist reduction method to be described later. If the actually-measured amount of mist is less than the predicted amount, a printing operation which prioritizes image quality (a printing operation which does not reduce mist) is executed. Presented with the above points, the inventors of the present invention have determined that optimum image output can be achieved without reducing the ink application amount more than necessary or causing adverse effects on user-friendliness.

Furthermore, by observing the image quality or the state of contamination in the printing apparatus after the printing operation, control is carried out to suppress occurrence of the mist in the next printing operation according to at least any one of the image quality and the state of contamination in the printing apparatus. For example, when it is determined, as a result of observation at the time after the printing operation, that the image quality is deteriorated, or that the printing apparatus is contaminated by the mist, to an unacceptable level, a printing operation for further reducing the mist is executed in the next printing operation. In contrast, when it is determined, as a result of observation at the time after the printing operation, that the image quality is deteriorated to the unacceptable level by reducing the amount of mist too much, the printing operation which prioritizes the image quality (the printing operation which does not reduce the mist), is executed in the next printing operation. Presented with the above points, the inventors of the present invention have determined that optimum image output can be achieved without reducing the ink application amount more than necessary or causing adverse effects on user-friendliness.

In the present specification, various conditions at the time of printing related to occurrence of the mist including the above-listed, and other conditions, will be hereinafter defined as "printing conditions."

Descriptions will be provided below for confirmation of the printing conditions and a printing method according to this embodiment. In this embodiment, each of the printing conditions described above can be confirmed with a printing mode set by the user via the printer driver. Additionally, the printing conditions described above can be confirmed by checking the image data or by detecting an output value of a temperature and humidity sensor installed inside the apparatus. Furthermore, the printing conditions described above can be confirmed also by using a sensor to detect the amount of mist during printing or by observing the image quality and the state of contamination in the printing apparatus after printing.

Figure 8:
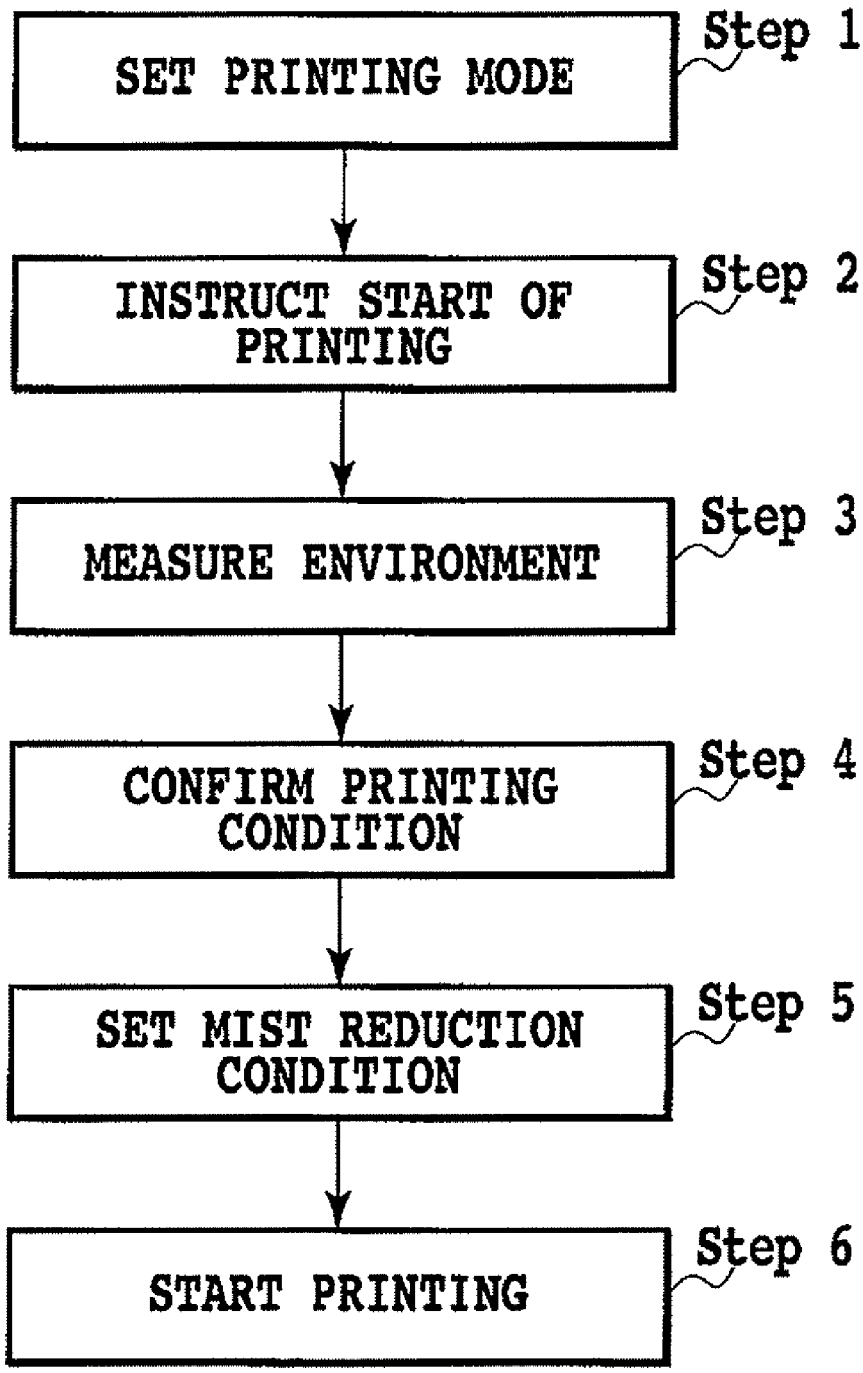
FIG. 8 is a flowchart for explaining each of steps for control of reducing occurrence of mist.

FIG. 8 is a flowchart showing steps for processing of reducing occurrence of the mist, from a step where the user sets the printing mode via the printer driver, to a step where the printing operation actually starts.

First, when outputting a desired image by using the printing apparatus, the user uses the printer driver to set a printing mode (Step 1). To be more specific, the user sets each of items such as a type of print medium, a high-speed mode or a high-definition mode, monochrome printing or color printing, and whether or not to perform margin-less printing. Thereby, an appropriate printing mode is selected and set. This setting of the printing mode makes it possible to confirm the carriage speed, the drive frequency, the printing position, the type of ink and the type of print medium, among the printing conditions described above.

When the setting of the printing mode is complete, the user inputs a printing start command via the printer driver (Step 2).

In the printing apparatus to which the printing start command is inputted, an output value of a thermometer and a hygrometer installed in the apparatus are checked (Step 3). Thereby, it is possible to grasp an extent of occurrence of the mist dependent on the temperature or the humidity.

In subsequent Step 4, the printing conditions obtained in Step 1 and Step 3 are confirmed. Moreover, by checking the inputted image data, the image density and the amount of ejection data are confirmed. Furthermore, the type of attached print head, the distance to the paper and the like are also confirmed.

In subsequent Step 5, mist reduction conditions are set on the basis of all of the obtained printing conditions as a result of Step 4. In this embodiment, a conversion table or the like for setting one mist reduction condition in response to the plurality of obtained printing conditions as a result of Step 4 is previously stored in the ROM 20*b* inside the apparatus. Thereafter, the processing advances to Step 6 to start image printing according to the mist reduction conditions set in Step 5.

When the printing operation is started in Step 6, an amount of mist, which is one of the printing conditions, is checked with a sensor installed inside the printing apparatus. For example, a humidity change is detected with a humidity sensor, and the amount of mist can be measured on the basis of the humidity change. Alternatively, an amount of reduction in light due to the mist between a light-emitting part and the light-receiving part is detected. The amount of mist can be then measured on the basis of the amount of reduction in light. During the printing operation, each of the printing conditions (1) to (10) described above, as well as the amount of mist, can be obtained. According to the obtained printing conditions, ink reduction processing to be described later can be performed.

After the printing operation is complete after Step 6, the image quality and the state of contamination in the printing apparatus, which are the printing conditions, are confirmed by observing the image on the print medium, and the printing apparatus.

Next, description will be given of mist reduction conditions to which the printing apparatus of this embodiment can respond. In the present specification, the mist reduction conditions include a "mist reduction method" and "mist reduction parameters." Here, the "mist reduction method" is means which executes processing for reducing the mist, that is, means which achieves reduction of the mist. The "mist reduction parameters" are defined as parameters for controlling the amount of mist to be reduced by the mist reduction method described above.

Here, several mist reduction methods applicable to this embodiment will be specifically described. In order to reduce the mist, it is effective to reduce an amount of ink to be applied to the print medium. An example of a method therefore is one utilizing image processing. As has been described with reference to FIG. 5, four stages of image processing, which are the color space conversion processing, color separation processing, the output γ processing and the binarization processing, are prepared in this embodiment.

Figure 9A:
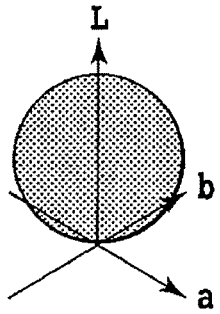
FIGS. 9A to 9D are views for explaining a method for reducing an application amount of ink by utilizing color space conversion processing.
Figure 9B:
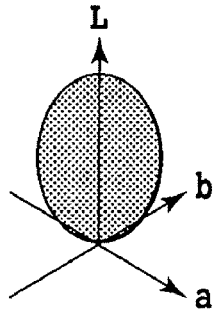

FIGS. 9A to 9D are views for explaining a method for reducing the amount of ink application by utilizing the color space conversion processing. Here, in order to explain a change in a color space due to the color space conversion processing, spaces before and after the color space conversion processing are shown by using luminance (L) as the vertical axis and chroma saturation (a, b) as plane axes. FIG. 9A shows a color space in a state before the color space conversion processing. FIG. 9B shows a color space in a state after the color space conversion processing. As shown in FIGS. 9A and 9B, in a case of conversion processing for a general ink jet printing apparatus, color spaces which can be expressed by the printing apparatus are in a reduced state as a whole, as compared with a color space of original image data.

Figure 9C:
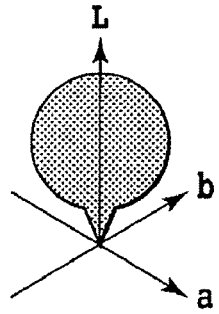
Figure 9D:
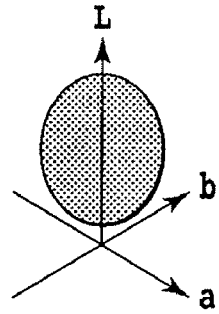

On the other hand, FIG. 9C shows a color space in a state after the color space conversion processing at the time when the mist reduction conditions are set. As is clear from FIG. 9C, the color space is narrowed in a direction toward lower chroma saturation (a and b) in a region where the luminance (L) is low. In such a color space, the chroma saturation (i.e., colors) is suppressed in a low luminance region, that is, a dark and blackish region. As a result, application amounts of color ink such as C, M and Y are suppressed in a region of an outputted image where black density is high. This method is effective for a printing apparatus using K ink since application of the color ink such as C, M and Y can be replaced with K ink. Specifically, occurrence of the mist can be effectively suppressed without losing image density more than necessary, by actively reducing the amount of ink application in a high density portion where the mist likely occurs, and by applying the ink accurately in accordance with the original, in portions of intermediate or lower density. As another method, there is also a method for shifting a space of low luminance data entirely toward higher luminance, as shown in FIG. 9D. According to this method, ink applied to a low luminance portion is suppressed, and an amount of mist to be generated can be reduced. Thus, the method is effective for both of the printing apparatus using K ink and that not using K ink.

As in this example, in a case where the method for reducing the ink application amount by utilizing the color-space conversion processing is adopted, appropriate mist reduction parameters are stored in the three-dimensional LUT used in the color space conversion processing. The method using the color space conversion processing as the mist reduction means has been described above. Meanwhile, similar correction can be actually performed in any one of the color separation processing and the output γ processing. Moreover, an additional step of reducing the ink application amount may be included at some point in a series of color processing steps. By adopting any one of processing, the object of this embodiment can be achieved as long as an obtained result is such that a converted value is properly corrected in a direction toward lower chroma saturation or in a direction toward higher luminance particularly for coordinates in the color space where occurrence of the mist is concerned.

Note that this embodiment or the present invention is not limited to the method for carrying out the color processing by use of the LUT as described above. A part of or all of the stages of color processing shown in FIG. 5 may be arithmetically processed. The conversion processing of this embodiment is performed by referring to the LUT or is arithmetically performed. Alternatively, correction and conversion are executed by use of a filter. In either case, the conversion processing is effective as long as the ink application amount can be reduced as a result.

Next, description will be given of a method for setting mist reduction conditions by quantization processing. First, considered is a case where an error diffusion method is adopted for the quantization processing. In the error diffusion method, a timing at which printing is set beyond a predetermined threshold can be controlled by changing the threshold or an error allocation amount. For example, if the threshold is previously set small, printing of dots is set at a relatively early timing. Meanwhile, if the threshold is set large, printing of dots is set at a later timing. In other words, the amount of ink applied to the region can be controlled by a set value of the threshold. Moreover, in a case where a target pixel does not exceed the threshold, the amount of ink applied to a predetermined region can be made less by reducing error allocating amount to surrounding pixels, or by allocating the error to pixels positioned farther away. In a case where the mist is reduced by use of the error diffusion method, parameters may be adjusted so as to set the threshold to be large according to an amount of mist to be reduced and suppress an allocation ratio. For example, when the margin-less printing is performed, a threshold for a vicinity of the edge of the print medium may be previously set to be large.

As described above, in a case where the error diffusion processing is adopted as the mist reduction method, the threshold and the error allocation amount correspond to the mist reduction parameters. Thus, mist reduction processing suitable for the printing conditions can be executed by selecting the values of the threshold and the error allocation amount according to the printing conditions.

Also in a case where dithering is adopted as the quantization processing, the ink application amount can be reduced by use of the same technique.

FIGS. 10A and 10B show threshold tables adopted in dithering. FIG. 10A shows an example of a threshold table at the time when no mist reduction conditions are set. FIG. 10B shows an example of a threshold table at the time when the mist reduction conditions are set. Here, for simplicity, each of FIGS. 10A and 10B shows thresholds in a region of 4 pixels×4 pixels. However, a table having a wider region may be actually used. In the threshold table of FIG. 10B in which the mist reduction conditions are set, some of the thresholds are set higher than those in FIG. 10A. As a result, an ink application amount in the 4×4 region can be set smaller than that in FIG. 10A.

As described above, in a case where the dithering is adopted as the mist reduction method, the threshold table itself corresponds to the mist reduction parameter. Thus, mist reduction processing suitable for the printing conditions can be executed by selecting a threshold table having different numerical arrays of thresholds according to the printing conditions.

The method for reducing the ink application amount by the image processing has been described above. Meanwhile, in the printing apparatus of this embodiment, the ink application amount can also be reduced by controlling the printing operation.

Figure 11A:
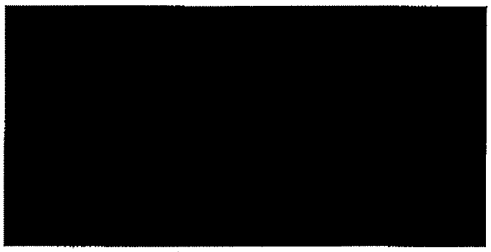
FIGS. 11A to 11C are views for explaining a method for reducing an application amount of ink by utilizing a mask pattern.
Figure 11B:
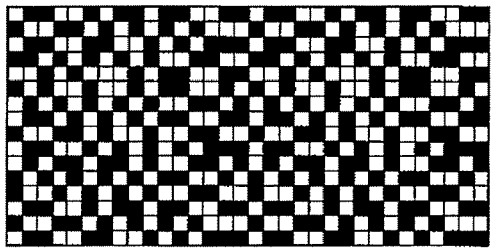
Figure 11C:
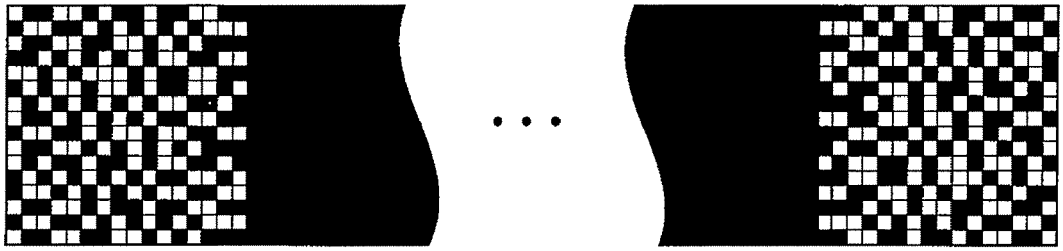

FIGS. 11A to 11C are views for explaining a method for reducing an ink application amount by use of a mask pattern. As has been described with reference to FIGS. 6A and 6B, the mask pattern is a pattern normally used for multi-pass printing. Meanwhile, the mask pattern can also be used for controlling the ink application amount. Here, for simplicity, description will be given of a case where 1-pass printing is performed, instead of the multi-pass printing.

In FIGS. 11A to 11C, black areas indicate pixels in which dot printing is allowed, and white areas indicate pixels in which dot printing is not allowed. FIG. 11A shows a mask pattern having a printing rate of 100%, in which printing of dots is allowed in all of the pixels. This pattern is generally used when the ink application amount is not particularly reduced. Meanwhile, FIG. 11B shows a mask pattern having a printing rate suppressed to reduce the ink application amount. The value of the printing rate can be controlled according to how much of the ink application amount is to be reduced.

However, even with the same printing rate, the content (a dispersion state of print permission pixels) of the mask pattern can adopt various modes. It is also confirmed that image quality is deteriorated depending on the content.

Figure 12A:
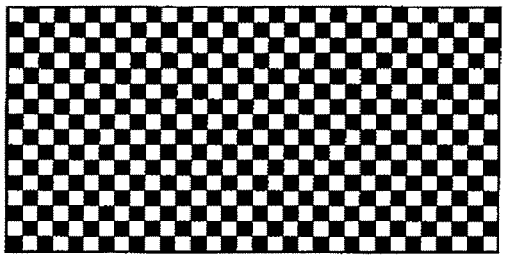
FIGS. 12A to 12C are views for explaining contents of mask patterns used for preventing deterioration of image quality as much as possible.
Figure 12B:
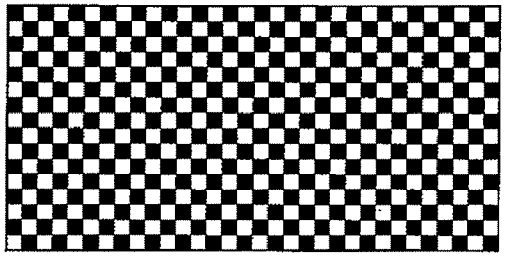
Figure 12C:
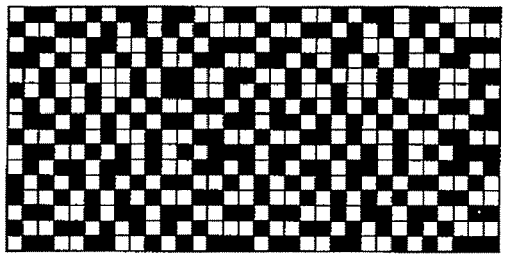

FIGS. 12A to 12C are views for explaining mask patterns for preventing deterioration of image quality as much as possible. FIG. 12A shows a mask pattern having a printing rate of 50% for reducing the ink application amount to half of the original amount. Here, FIG. 12A shows a checked mask pattern in which print permission pixels and print non-permission pixels are alternately arranged in both vertical and horizontal directions. In contrast, FIG. 12B shows an arrangement example of printing data in a state after binarization in a predetermined region. In the quantization processing, while the processing depends on a binarization method to be adopted, it is also supposed that printing data is outputted in such a checked arrangement. Such a relationship between the printing data and the mask pattern leads to results where no dot is printed in the region, or where all of the dots are printed to show no effect of reducing the ink application amount. For this reason, it is recognized that it is required to set a mask pattern which does not synchronize with the arrangement of the printing data in a state after quantization, that is, a mask pattern which makes it possible to print dots at a given printing rate regardless of a kind of arrangement held in the binary data.

FIG. 12C shows a mask pattern having a printing rate of 50%, in which print permission pixels are relatively randomly arranged. Such a mask pattern allows printing while maintaining the printing rate of 50% even if the printing data as shown in FIG. 12B is inputted. Specifically, printing can be performed with an appropriate ink application amount and image quality without deteriorating an image by deleting almost of the printing data, or without losing the effect of reducing the ink application amount by printing all of the printing data.

Here, margin-less printing will be considered as a concrete example for reducing the ink application amount by use of the mask pattern. In the case of margin-less printing, concerned occurrence of the mist can be effectively suppressed by causing the amount of ink applied to an edge region of the print medium to be less than that applied to an inner region thereof. Such printing can be achieved by using a mask pattern having a printing rate suppressed in the edge region of the print medium, and by using a mask pattern having a printing rate of 100% in the inner region, as shown in FIG. 11C.

Figure 13A:
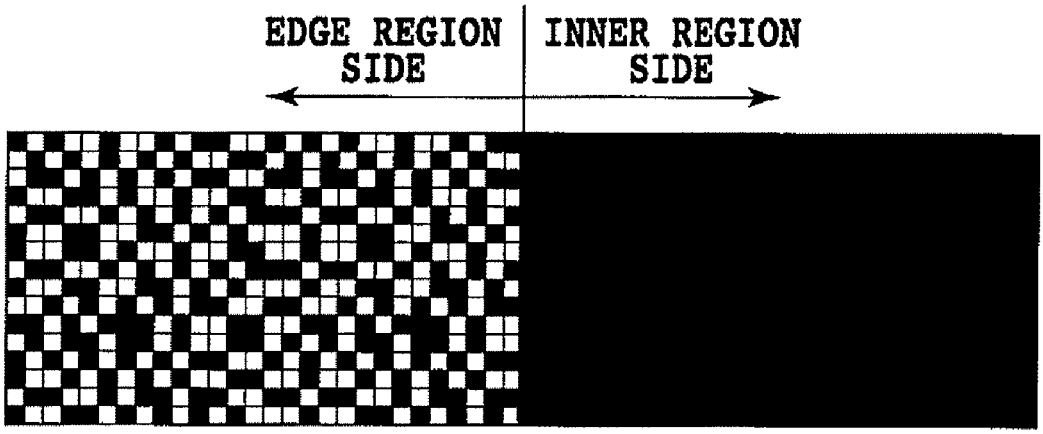
FIGS. 13A and 13B show patterns obtained by further modifying the mask pattern shown in FIG. 11C.
Figure 13B:
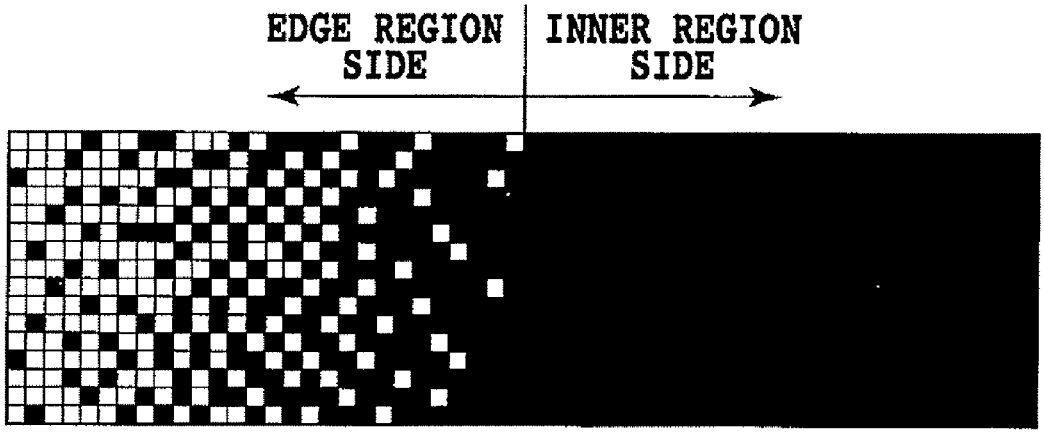

FIGS. 13A and 13B show mask patterns obtained by further modifying the mask pattern shown in FIG. 11C. FIG. 13A is a view showing a boundary between the edge region and the inner region in the mask pattern shown in FIG. 11C. Such a case where there is a large difference in the printing rate between the edge region and the inner region may cause image deterioration since a density difference is recognized in the boundary. In contrast, the mask pattern as shown in FIG. 13B in which the printing rate is gradually increased from the edge region toward the inner region, has no spot where the printing rate is drastically changed in the boundary. Thus, the image deterioration due to an extreme density difference does not occur.

As described above, in the case where data thinning processing using the mask pattern is adopted as the mist reduction method, the mask pattern itself corresponds to the mist reduction parameter. Hence, mist reduction processing suitable for the printing conditions can be executed by selecting mask patterns different in the printing rate or in arrangement of print permission pixels, according to the printing conditions.

Setting of the mist reduction conditions and maintenance of good image quality are often in a trade-off relationship not only in the case of using the mask pattern but also in other cases. Particularly, in this embodiment, the ink application amount is reduced, that is, data to be printed is reduced in order to reduce the mist. For this reason, insufficient density, insufficient color development, lack of data and the like may be recognized as image deterioration. Consequently, in a case where the mist reduction conditions are set as in the present invention, it is important to confirm the printing conditions described above sufficiently, to grasp the amount of mist to be reduced and to set such balanced mist reduction parameters that does not cause noticeable deterioration in image quality.

As described above, in the ink jet printing system of this embodiment, the mist can be effectively reduced without degrading the image quality, by utilizing, after confirming the printing conditions, any one of the color processing, the quantization processing and the mask pattern, as the mist reduction means. Particularly, the mist reduction conditions are changed according to the printing conditions. To be more specific, out of the plurality of different mist reduction conditions, the mist reduction conditions corresponding to the printing conditions are set. Thus, it is possible to carry out the mist reduction processing suitable for the printing conditions.

Second Embodiment

Also in this embodiment, the same ink jet printing apparatus as that of the first embodiment is used to execute each of steps for setting mist reduction conditions, and then for printing according to the flowchart shown in FIG. 8. In the first embodiment, occurrence of mist is suppressed by reducing the ink application amount in the data processing. Meanwhile, in this embodiment, reduction of the mist is achieved not by reducing the ink application amount but by changing a printing method for the printing apparatus. As has been described above, occurrence of the mist is particularly concerned when any one of the items (1) to (10) described above meets a predetermined condition. For this reason, as to the items which can be controlled by the printing apparatus, among the items (1) to (10), suppression of the mist can be expected by applying the conditions in a direction opposite to induction of occurrence of mist.

Table 1 shows methods A to D for reducing the mist, and specific reduction parameters thereof.

TABLE 1

| | Reduction method | Reduction parameter | Effects |
|---|---|---|---|
| A | Change number of passes (increase the number of passes) | Number of passes (for example, 1, 2, 3, 4, 8, 12 and 16) | Ejection frequency of print head in each printing scan is reduced, and thereby mist is suppressed. |
| B | Change carriage speed (set low carriage speed) | Speed (for example, 20 inch/sec, 25 inch/sec and 40 inch/sec) | Airflow caused by carriage movement is reduced together with ejection frequency from print head, and thereby mist is suppressed. |

TABLE 1-continued

| | Reduction method | Reduction parameter | Effects |
|---|---|---|---|
| C | Change overrunning width in margin-less printing (reduce overrunning amount) | Overrunning width (for example, 0 mm, 1 mm, 2 mm and 3 mm) | Ink droplets ejected to outside of print medium are reduced, and thereby mist is suppressed. |
| D | Change distance to the paper (shorten distance to the paper) | Distance (for example, 1 mm, 1.2 mm and 1.5 mm) | Occurrence of mist between ejection port and surface of print medium is suppressed. |

Even in a case other than the above cases, where the apparatus uses a print head capable of controlling, for example, an ejection amount of ink droplets, an ejection speed and a drive frequency, it is also effective to use such control means for the items. The ink droplets are less likely to be changed into the mist because, by increasing the ejection amount and the ejection speed, the ink droplets are less likely influenced by external factors such as the airflow, and reach target positions (the print medium or the absorber). Moreover, the ink droplets are less likely influenced by external factors such as the airflow, by lowering the carriage speed with the suppressed drive frequency, or by increasing the size of the ink droplets.

The inventors of the present invention have checked each item as to whether or not applications of the reduction methods A to D shown in Table 1 are effective in mist reduction even in a case where the items (1) to (10) listed above meet conditions such as to cause occurrence of mist. Table 2 shows the results.

TABLE 2

| | Printing conditions | Effects of reduction conditions A to D |
|---|---|---|
| (1) | Carriage speed | Even if carriage speed is high, adoption of printing methods A, C and D is effective in mist reduction. |
| (2) | Drive frequency | Even if drive frequency is high, adoption of printing methods A to D is effective in mist reduction. |
| (3) | Image density | Even if image density is high, adoption of printing methods A to D is effective in mist reduction. |
| (4) | The number of ejection data | Even if the number of ejection data is large, adoption of printing methods A to D is effective in mist reduction. |
| (5) | Printing position | Even when printing in edge region of print medium, adoption of printing methods A to D is effective in mist reduction. |
| (6) | Ejection volume | Even if ink droplets are small, adoption of printing methods A to D is effective in mist reduction. |
| (7) | Type of ink | Even if ink which relatively easily causes mist is used, adoption of printing methods A to D is effective in mist reduction. |
| (8) | Type of print medium | Even if print medium has low absorption coefficient, adoption of printing methods A to D is effective in mist reduction. |
| (9) | Distance to the paper | Even if distance to the paper is long, adoption of printing methods A to C is effective in mist reduction. |
| (10) | Printing environment | Even in an environment with temperature and humidity where mist likely occurs, adoption of printing methods A to D is effective in mist reduction. |

Also in this embodiment, as in the case of the first embodiment, it is preferable that a plurality of different reduction parameters can be selected so as to allow a degree of mist reduction to be controlled in multiple stages according to the contents of the printing conditions. Such setting is achieved by selecting, according to the printing conditions confirmed in Step 4, at least one reduction method (for example, the number of passes) from the previously-prepared plurality of reduction conditions, and the reduction parameter (for example, 4 passes) corresponding to the selected reduction method. Note that the setting described above can be easily achieved if the table in which the reduction methods and the respective reduction parameters are associated with each other, is prepared.

In this embodiment, unlike the first embodiment, the printing data is not deleted for reducing the mist. However, setting of the mist reduction conditions may influence the image quality, user-friendliness of the printing apparatus, and the like. For example, although occurrence of the mist can be suppressed by increasing the number of passes of multi-pass printing, extra printing time is required, and thereby throughput is lowered. Moreover, reduction in the distance to the paper increases a risk of the print head and the print medium being in contact with each other. Consequently, also in this embodiment, it is important to set balanced mist reduction conditions suitable for the printing conditions, out of the plurality of different mist reduction conditions, so as not to cause noticeable adverse effects on the image quality, the user-friendliness of the printing apparatus, and the like.

Other Embodiments

In the above embodiments, the description has been given of the printing apparatus and the external device (host), which can execute the plurality of mist reduction methods (the color processing, the quantization processing, the data thinning processing, increase in the number of passes of multi-pass printing, lowering of the carriage speed, reduction in the overrunning width, reduction in the distance to the paper, and the like). Meanwhile, the present invention is not limited to the configuration in which the plurality of mist reduction methods described above can be executed within one apparatus. It is also possible to adopt a configuration in which one type of mist reduction method can be executed within one apparatus. When one type of mist reduction method can be executed within one apparatus, a configuration capable of setting, in multiple stages, mist reduction parameters corresponding to that mist reduction method, may be adopted.

In the two embodiments described above, the descriptions have been given of the cases where the data processing in the first embodiment and the printing control in the second embodiment are used as the mist reduction means. These different means may be combined together to set the mist reduction conditions. Specifically, a plurality of reduction means among the color processing, the quantization processing, the data thinning processing using the mask pattern, increase in the number of passes of the multi-pass printing, lowering of the carriage speed, reduction in the overrunning width, reduction in the distance to the paper, and the like may be concurrently used to set the mist reduction conditions. For example, when the margin-less printing is executed, multi-pass printing may be performed by setting the number of passes in front and rear edge regions larger than the number of passes in the inner region, while coordinating image data corresponding to the edge of the print medium by the color processing. Such printing control can be achieved if a prepared printing-condition setting table allows concurrent use of a plurality of reduction means, or if the table makes it possible to switch reduction means according to the printing conditions. However, in the present invention, the means for setting the suitable reduction conditions according to the printing conditions is not limited to the method using the table. In a case where the plurality of reduction means are used, the reduction means including the color processing and the quantization processing makes it possible to execute processing by the printer driver in the external device 29 connected to the outside of the printing apparatus. Meanwhile, switching of the mask pattern can be executed by any one of the printing apparatus and the printer driver in the external device. When the plurality of mist reduction means are concurrently used, the effects of the present invention can be achieved even if the reduction means are respectively controlled by the different devices. The present invention is effective for any type of combination of any one of the mist reduction means as long as suitable mist reduction conditions are set out of the plurality of mist reduction conditions, according to the printing conditions.

Moreover, in the above embodiments, the description has been given of the example where the image processing, such as the color processing and the quantization processing, which is adopted as the mist reduction method, is executed by the printer driver in the external device. However, the present invention is not limited to the above configuration. For example, the mist reduction method using the image processing may be executed by the printing apparatus using programs stored in the ROM 20*b* in the apparatus for executing the image processing, such as the color processing and the quantization processing. In this case, the mist reduction conditions including the mist reduction method and the mist reduction parameters corresponding to the mist reduction method, is set only by the printing apparatus.

As one favorable embodiment of the present invention, the mist reduction conditions including the mist reduction method and the mist reduction parameters corresponding to the mist reduction method, is set according to the printing conditions. Accordingly, the mist reduction conditions may be set by any one of the printing apparatus and the external device, or both. For example, when the mist reduction conditions are set by the printing apparatus, the printing apparatus serves as a mist-reduction-condition setting apparatus of the present invention. On the other hand, when the mist reduction conditions are set by the external device, the external device serves as the mist-reduction-condition setting apparatus of the present invention. In this case, the mist reduction conditions set by the external device are transferred to the printing apparatus, and printing is performed by the printing apparatus on the basis of the mist reduction conditions. Alternatively, when the mist reduction conditions are set by the printing apparatus and the external device, the printing system including the printing apparatus and the external device serves as the mist-reduction-condition setting apparatus of the present invention.

In the above embodiments, the description has been given of the ink jet printing apparatus to which the external device 29 is connected, as an example, with reference to FIG. 4. Meanwhile, the present invention is not limited to the above configuration. It is also possible to achieve direct printing (PD) for printing an image received from an input unit directly on a print medium, without using the external device 29, by use of programs for executing all of the image processing. Here, the programs are stored in the ROM 20*b* in the ink jet printing apparatus. In a case of the direct printing, a digital camera, a scanner or the like can be used as the input unit, and the type of print medium or input of the printing start command can be set by an operation panel 22. The printing apparatus of the present invention may have a function of a copier integrated with a scanner which optically reads an image. Furthermore, the printing apparatus may be a multifunction printer (MFP) with multiple functions, such as a direct print function, a print function connected to a PC, and a function as a copier.

Furthermore, in the image processing described with reference to FIG. 5, the description has been given of the case where the 8-bit R, G and B data are respectively converted into the 1-bit C, M, Y and K data. However, the present invention is not limited to the above the number of bits or the number of ink colors. Many ink jet printing apparatuses mounting much more types of ink than C, M, Y and K have recently been provided. Any kind of conversion processing may be executed as long as printing signals corresponding to ink colors to be used are finally outputted.

It is needless to say that the scope of the present invention also includes a configuration in which software for achieving the functions handled by the external device in the foregoing embodiments, or a program code of the printer driver is supplied to the computer, and which is operated by the program code stored in the computer.

In this case, the program code itself achieves a new function of the present invention. Hence, the scope of the present invention also includes the program code itself and means which supplies the program code to the computer through communications, a storage medium or the like.

As the storage medium for supplying the program code, for example, a hard disk, an optical disk, a magneto-optical disk, a CD-R, a DVD, a magnetic tape, a nonvolatile memory card, a ROM and the like can be used in addition to a flexible disk and a CD-ROM.

Moreover, the present invention is not limited to the configuration in which the functions of the foregoing embodiments are achieved by executing the program code read by the computer. The scope of the present invention also includes a case where an OS or the like operated on the computer executes a part of or the entire actual processing on the basis of an instruction of the program code, and where the functions of the embodiments are achieved by the processing.

Furthermore, the scope of the present invention also includes such a configuration that the program code read from the storage medium is written into a memory included in a function expansion board inserted into the computer or in a function expansion unit connected to the computer. In this case, a CPU or the like included in the function expansion board or the function expansion unit executes a part of or the entire actual processing on the basis of an instruction of the written program code, and the functions of the embodiments are realized by the processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-126864, filed Apr. 28, 2006, which is hereby incorporated by reference herein in its entirety.

What is claimed is:

1. An apparatus for setting mist reduction conditions for reducing ink mist caused by ink ejection from a print head, comprising:

means for acquiring printing conditions related to an amount of generated ink mist that scatters in a printer mounted with the print head; and means for setting a quantization threshold corresponding to the acquired printing conditions, wherein the quantization threshold is set to control a degree of reducing the ink mist, and wherein the quantization threshold is a threshold for execution of quantization processing of image data for printing an image.

2. The apparatus according to claim 1, wherein the apparatus is comprised of the printer for printing on a print medium on the basis of the quantization threshold set by the setting means.

3. The apparatus according to claim 1, wherein the apparatus is comprised of an external device connected to the printer for printing on a print medium on the basis of the quantization threshold set by the setting means.

4. An ink jet printing method for printing an image on a print medium by use of a print head which ejects ink, comprising:

an acquiring step for acquiring printing conditions related to an amount of generated ink mist that scatters in a printer mounted with the print head; and a setting step for setting a quantization threshold corresponding to the acquired printing conditions, wherein the quantization threshold is set to control a degree of reducing the ink mist, and wherein the quantization threshold is a threshold for execution of quantization processing of image data for printing an image.

5. A system including an ink jet printer which prints an image on a print medium by use of a print head which ejects ink, and an external device connected to the printer, wherein the external device comprises:

means for acquiring printing conditions related to an amount of generated ink mist that scatters in the printer mounted with the print head; and means for setting a quantization threshold corresponding to the acquired printing conditions, wherein the quantization threshold is set to control a degree of reducing the ink mist, and wherein the quantization threshold is a threshold for execution of quantization processing of image data for printing an image.

6. A computer-readable storage medium retrievably storing a computer program, wherein the program causes a computer to execute a method for setting a mist reduction condition for reducing ink mist caused by ink ejection from a print head, the method comprising the steps of:

an acquiring step for acquiring printing conditions related to an amount of generated ink mist that scatters in a printer mounted with the print head; and a setting step for setting a quantization threshold corresponding to the acquired printing conditions, wherein the quantization threshold is set to control a degree of reducing the ink mist, and wherein the quantization threshold is a threshold for execution of quantization processing of image data for printing an image.

* * * * *